United States Patent [19]

Mendenhall

[11] 3,954,184

[45] May 4, 1976

[54] SHELF PARTITION

[76] Inventor: Walter M. Mendenhall, 8026 28th Ave, North, St. Petersburg, Fla. 33710

[22] Filed: Feb. 5, 1975

[21] Appl. No.: 547,186

[52] U.S. Cl. ..... 211/184
[51] Int. Cl.[2] ..... A47F 5/00
[58] Field of Search..... 211/184, 183, 177; 24/73 PF, 73 P, 73 PM

[56] References Cited

UNITED STATES PATENTS

| | | | |
|---|---|---|---|
| 2,700,399 | 1/1955 | Pfarrwaller | 24/73 P |
| 2,855,258 | 10/1958 | Moncier | 211/184 |
| 3,089,269 | 5/1963 | McKiernan | 24/73 PF |
| 3,501,019 | 3/1970 | Armstrong et al. | 211/184 |
| 3,803,670 | 4/1974 | Johnson | 24/73 P |

FOREIGN PATENTS OR APPLICATIONS

| | | | |
|---|---|---|---|
| 1,307,894 | 12/1961 | France | 24/73 PM |

*Primary Examiner*—Roy D. Frazier
*Assistant Examiner*—Robert A. Hafer

[57] ABSTRACT

A shelf partition designed for easy attachment to, and removal from, a display shelf or the like. A main body portion includes a plurality of integral retaining members, each of which may be inserted into, or removed from, a recess in the shelf. Each retaining member includes a flexible member which carries a locking surface. The flexible member is designed to be cammed away from an edge of a recess as the flexible member is inserted into or removed from the recess. In a particular embodiment the partition is retained in place by means of a plurality of generally hook-shaped tab members with the retaining members being disposed between the tab members and the main body portion of the partition.

3 Claims, 9 Drawing Figures

SHELF PARTITION

BACKGROUND OF THE INVENTION

The present invention relates to partitions of the type which are used to separate shelves for display cases or the like into distinct compartments. In particular, the following specification discloses a partition which can be easily attached to, or removed from, a display shelf.

A known type partition is shown in U.S. Pat. No. 3,501,019. The partition includes elongated portions having tabs, and the elongated portions are designed to be bent in order to permit insertion and removal of the partition from engagement with the diamond-shaped perforations of the shelf. In order to remove such a partition from the shelf it is generally necessary to hold the main body portion of the partition with one hand while the elongated portion is bent with the other hand to release the tabs from the perforations.

SUMMARY OF THE PRESENT INVENTION

The present invention provides a partition which is designed for easy insertion and removal from display shelves or the like. In fact, the partition is designed to be inserted and removed from a shelf with only one hand. The partition, preferably formed of plastic, includes a main body portion, and one or more retaining members which are inserted into perforations in the shelf, and act to resist accidental disloding of the partition from the shelf. The retaining members are particularly suitable for use with existing shelves having diamond-shaped recesses. Each retaining member includes one or more members integral with the main body of the partition and each member includes a pair of camming surfaces and a locking surface. When the retaining member enters a recess a first camming surface engages an edge of a recess, and the flexible member is urged away from the edge of the recess. The urging of the flexible member away from the edge of the recess permits the locking surface to extend through the recess and the flexible member, by its own resilience, can snap back to its original set, whereupon the locking surface is effective to align with the underside of the shelf to resist accidental disloding of the partition.

The retaining member also includes second camming surfaces designed to engage an edge of the recess to urge the flexible member away from the edge of the recess during removal of the partition. Preferably, the design of the camming surfaces is such that it is slightly more difficult to urge the flexible member away from the recess during removal than during insertion. This is because the partition is to be retained against accidental removal while still permitting relatively easy removal when desired.

The main body portion preferably includes a planar surface which extends at a right angle to the main body portion, and the retaining members extend from the underside of the planar body. In a particular embodiment the underside of the planar body includes a plurality of retaining members and a plurality of generally hook-shaped tab members with the retaining members being disposed between the tab members and the main body portion. The tab members are designed so as to be less subject to wear than are the retaining members, and yet which combine with the retaining members to effectively lock the partition in place.

Thus, it is the principal object of the present invention to provide a partition which can be easily attached to and removed from a display shelf or the like.

Other objects and advantages of the present invention will be further apparent from the following description and the accompanying drawings wherein:

DETAILED DESCRIPTION OF AN EMBODIMENT OF THE PRESENT INVENTION

Figure 1:
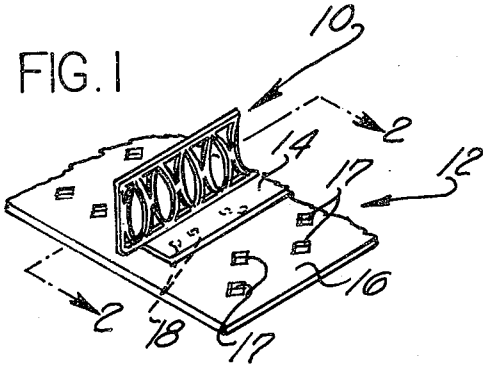
FIG. 1 is a fragmentary schematic view showing a partition in place after insertion.

FIG. 1 shows a shelf partition embodying the present invention attached to a shelf. The partition includes a main body portion 10 which divides the shelf 12 into distinct compartments. The lower end of the main body portion 10 includes a planar member 14 which extends at a right angle to main body portion 10 and rests upon an upper surface 16 of the shelf. The shelf 12 includes a plurality of recesses 17 which are diamond shaped, as is typical of many presently existing shelves.

Figure 2:
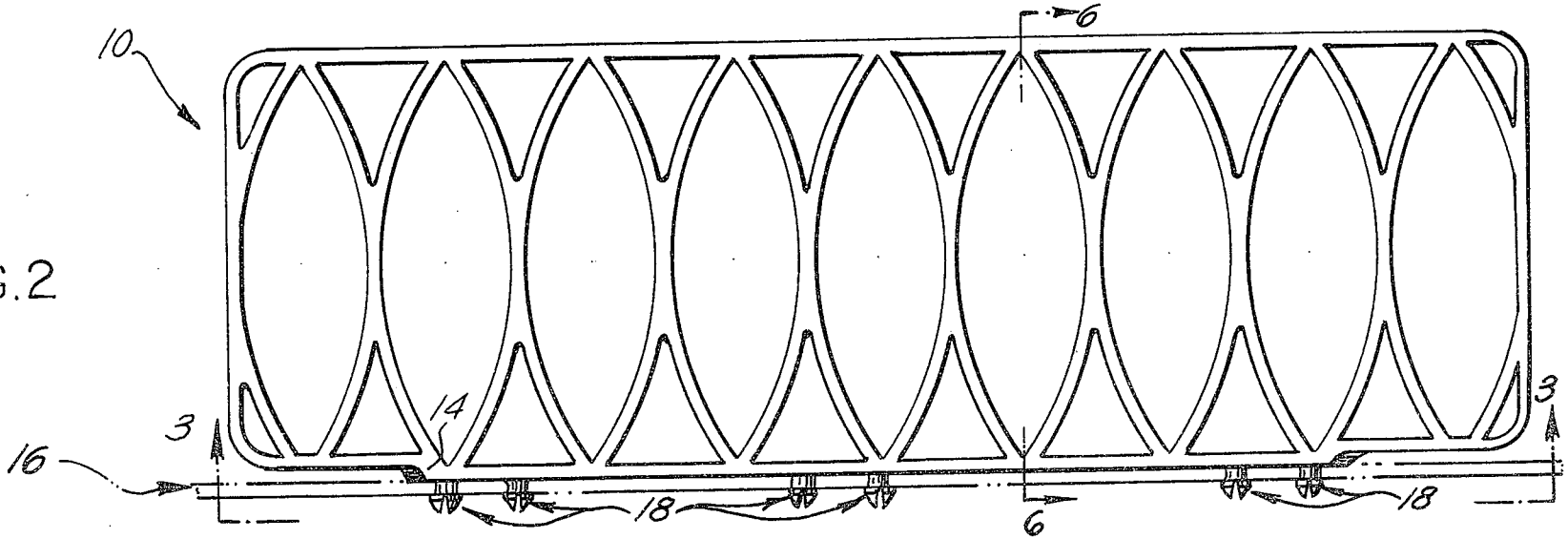
FIG. 2 is a side view of a partition according to the present invention, taken from the direction represented by 2—2 in FIG. 1, and with the shelf represented by broken lines.
Figure 3:
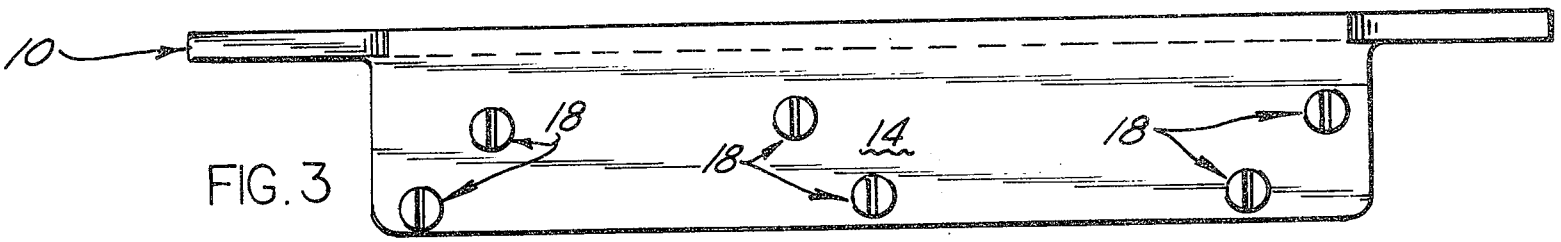
FIG. 3 is a bottom view of the partition of FIG. 2, taken from the direction represented by line 3—3 of FIG. 2, and with the shelf omitted.

Referring now to FIGS. 2 and 3, the underside of the planar member 14 includes a plurality of retaining members 18, which are designed to engage the diamond-shaped recesses in the shelf. The main body portion 10, the planar member 14, and the retaining member 18 are plastic and are preferably formed as a single molded member.

Figure 5:
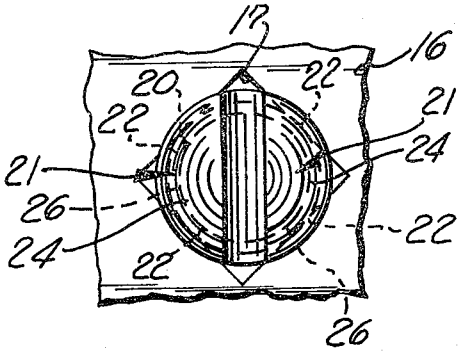
FIG. 5 is a representation of the underside of part of a shelf with a retaining member inserted in a recess.
Figure 4:
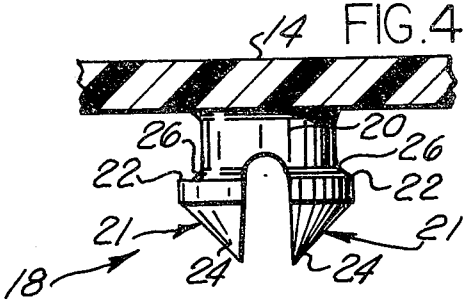
FIG. 4 is an enlarged view of a retaining member according to the present invention.

Each retaining member, in its preferred form, is similar to the one shown in FIG. 4. A shank portion 20 is integral with planar member 14, and includes flexible members 21, each of which carries a locking surface 22 spaced from the planar member 14 by a distance at least as great as the thickness of the shelf. Each flexible member 21 also includes a first camming surface 24 which is preferably formed as a portion of a conical surface. As a retaining member is inserted into a recess, each camming surface 24 engages an edge of the recess and urges the flexible members away from the respective edge. When the locking surfaces 22 have cleared the underside of the shelf, the flexible members are free to snap back to their original set. The locking surfaces 22 are then in position to align with the underside of the shelf to resist accidental dislodging of the partition. In addition, as may be clearly seen by reference to FIG. 5, the locking surfaces 22 are preferably arcuate and are aligned with the undersurface of the shelf adjacent each of the diamond-shaped recesses, thus being capable of providing particularly effective resistance to accidental dislodgement.

Again referring to FIG. 4, each resilient member includes a second camming surface 26 between the locking surface 22 and the shank 20. As the partition is pulled away from the shelf each camming surface 26 engages an edge of a recess to urge the flexible member 21 away from the edge of the recess to permit the locking surfaces 22 to clear the recess.

The combined effect of the first and second camming surfaces permits the partition to be attached to, or removed from, a shelf by simply moving the partition in such a manner that the retaining members move perpendicular to the surface of the display shelf. This type of insertion or removal can be easily accomplished with the partition held in only one hand.

Figure 6:
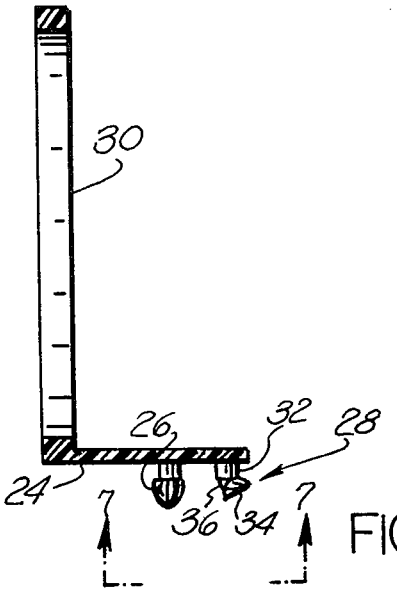
FIG. 6 is a cross sectional view of a partition similar to the one shown in FIG. 1, and showing a modified embodiment of the present invention.
Figure 7:
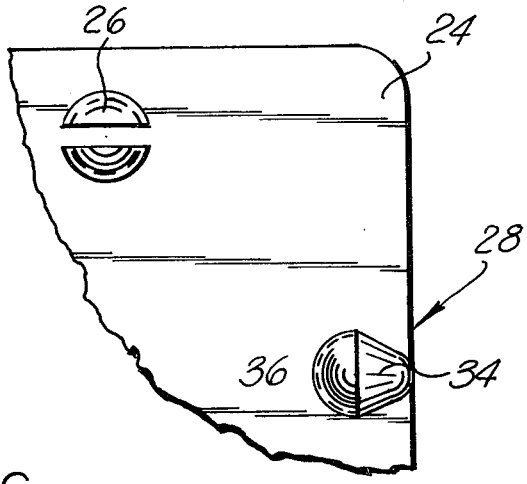
FIG. 7 is a fragmentary bottom view of the embodiment of FIG. 6.
Figure 8:
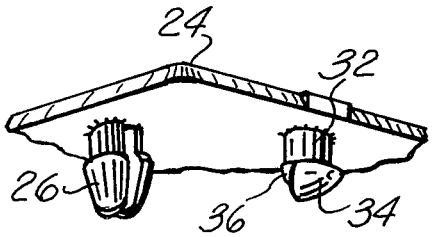
FIG. 8 is a fragmentary perspective view of the embodiment of FIG. 6.

A modified form of the present invention is shown in FIGS. 6, 7 and 8. The underside of the planar surface 24 includes a plurality of retaining members 26 and a plurality of tab members 28. The retaining members 26 are disposed between the tab members 28 and the main body portion 30.

The retaining members 26 are generally similar to the retaining members of FIGS. 1 through 5. Each tab member 28 is a generally hook-shaped member which formed by a shank member 32 extending perpendicular to the planar surface 24, and an integral flange portion 34 whose axis of symmetry extends generally at a right angle thereto. The end of the shank 32 preferably includes a tapered nose portion 36, and the flange 34 is generally conically shaped.

The partition disclosed in the embodiment of FIGS. 6 through 8 is easily attached to a shelf. The shelf is inserted at an angle with the tab members 28 leading. The retaining members 26 will still be suitably cammed by engagement with the edges of the recesses so as to clear the recesses. Again, as with the previous embodiment, insertion is easily accomplished with the partition held in only one hand.

The embodiment of FIGS. 6 through 8 has additional advantages. The tab members resist forward tipping of the partition, while being considerably less subject to wear than the retaining members. This embodiment is, therefore, designed to function better under excessive wear than the previous embodiment.

Figure 9:
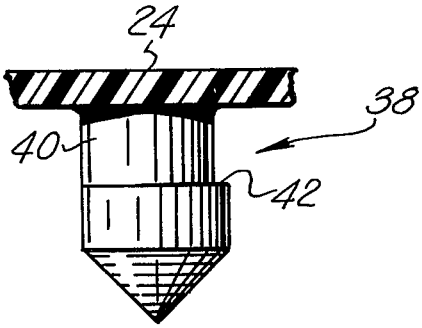
FIG. 9 is a cross sectional view of another modified form of the present invention.

FIG. 9 illustrates a further embodiment. The partition is formed of retaining members, and tab members such as 38, with the tab members being of slightly different form than the embodiment of FIGS. 6 through 8. The tab members include cylindrical shank portions 40, the back portion of which is undercut by approximately 0.0075 in. to form locking surfaces 42 which intersect shank portions 40 at approximately 90°. Insertion of this type partition is similar to that of the previous embodiment.

Thus, the present invention provides a partition which can be easily inserted or removed from recesses in a display shelf or the like. Of course, while the preferred embodiment is particularly suitable for shelves with diamond-shaped recesses, partitions employing the basic principles of the present invention can be constructed to be particularly suitable for shelves with different shaped recesses.

Having described the invention, what is claimed is:

1. A partition for dividing shelves or the like into distinct compartments, said partition comprising a main body portion, a planar member integral with an edge of said main body portion and extending generally perpendicular thereto, a plurality of retaining means integral with said planar member and designed for insertion into recesses in the shelf for retaining the partition against accidental dislodgment from the shelf, each of said retaining means including a flexible member having a locking surface, camming means carried by said flexible member and including a first surface adapted to engage an edge of said recess as said retaining means is inserted into said recess to urge said flexible member away from the recess until said locking surface clears said recess, and a second surface adapted to engage an edge of said recess to urge the flexible member away from said recess during removal of the partition from the shelf, whereupon after insertion said flexible member is free to return to its original set and said locking surface is aligned with an undersurface of the shelf to resist accidental dislodgment of the partition from the shelf, and after removal said flexible member also returns to its original set to permit subsequent attachment of the partition to a shelf, a plurality of tab members integral with said planar member and designed for insertion into recesses in the shelf, each of said tab members having a generally hook-shaped configuration including a shank and a locking portion integral with the shank and disposed angularly to the shank, each of the locking portions being effective to resist tipping of the partition about the junction of the main body portion and the planar member and to also resist dislodgment of the partition by movement normal to the surface of the planar member, said tab members being spaced further from said main body portion than said retaining members, whereby said partition may be inserted at an angle to the shelf surface with said tab members leading, and the retaining members will thereafter engage the edges of the recesses.

2. A partition as set forth in claim 1 wherein each tab member includes a cylindrical shank portion, and each locking portion includes a conical portion, said conical portion having an axis of symmetry extending substantially perpendicular to the axis of said shank portion.

3. A partition as set forth in claim 1 wherein said tab member includes a cylindrical shank portion, and said locking portion comprises a planar surface intersecting said cylindrical shank portion at approximately 90°.

* * * * *